US009151072B2

(12) United States Patent
Choi

(10) Patent No.: US 9,151,072 B2
(45) Date of Patent: Oct. 6, 2015

(54) FOLDABLE TENT

(71) Applicant: Ki Ho Jin, Xiamen (CN)

(72) Inventor: Kwan Jun Choi, Hamyang-Gun (KR)

(73) Assignee: Ki Ho Jin, Xiamen (CN)

( * ) Notice: Subject to any disclaimer, the term of this patent is extended or adjusted under 35 U.S.C. 154(b) by 0 days.

(21) Appl. No.: 14/140,148

(22) Filed: Dec. 24, 2013

(65) Prior Publication Data

US 2014/0109947 A1 Apr. 24, 2014

Related U.S. Application Data

(63) Continuation of application No. 13/870,714, filed on Apr. 25, 2013, which is a continuation of application No. 12/658,473, filed on Feb. 4, 2010, now Pat. No. 8,448,656, which is a continuation-in-part of application No. PCT/CN2008/073142, filed on Nov. 21, 2008.

(30) Foreign Application Priority Data

Nov. 30, 2007 (CN) ..... 2007 2 0008991 U

(51) Int. Cl.

| | |
|---|---|
| ***E04H 15/36*** | (2006.01) |
| ***E04H 15/48*** | (2006.01) |
| ***E04H 15/44*** | (2006.01) |
| ***E04H 15/42*** | (2006.01) |

(52) U.S. Cl.

CPC ..... *E04H 15/48* (2013.01); *E04H 15/42* (2013.01); *E04H 15/44* (2013.01)

(58) Field of Classification Search

USPC ..... 135/135, 120.3, 125, 136, 147

See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 2,113,118 | A | 4/1938 | Pyatt |
| 2,306,706 | A | 12/1942 | Lucas |

(Continued)

FOREIGN PATENT DOCUMENTS

| | | | |
|---|---|---|---|
| CA | 2022369 | A1 | 2/1991 |
| CN | 1030790 | C | 1/1996 |

(Continued)

OTHER PUBLICATIONS

International Search Report for PCT/CN2008/073142, dated Jan. 22, 2009.

*Primary Examiner* — Noah Chandler Hawk
(74) *Attorney, Agent, or Firm* — John H. Choi

(57) ABSTRACT

A foldable tent includes a hub, a base having a plurality of separate base members and a plurality of slots formed on the base members. The plurality of slots are uniformly spaced apart radially, each slot formed by first and second walls, each of the first and second walls integrally formed on the respective base member and substantially parallel to each other. A plurality of poles are included, with each pole having at least two sections coupled by a joint. Each pole includes an inner end and an outer end, each pole inner end pivotally coupled to a corresponding slot. The hub and poles define a periphery when the tent is in an open configuration. A canopy is positioned within the periphery, the canopy being slidably connected to the poles in the open configuration and a closed configuration.

14 Claims, 8 Drawing Sheets

(56) References Cited

U.S. PATENT DOCUMENTS

| | | | |
|---|---|---|---|
| 2,448,895 | A | 9/1948 | Lawrence |
| 2,530,765 | A | 11/1950 | Greenup |
| 2,555,220 | A | 5/1951 | Brown |
| 2,731,972 | A | 1/1956 | Braun |
| 2,948,287 | A | 8/1960 | Rupert |
| 2,953,145 | A | 9/1960 | Moss et al. |
| 2,962,034 | A | 11/1960 | Finlayson |
| 2,984,249 | A | 5/1961 | Sears, Jr. et al. |
| 3,054,413 | A | 9/1962 | Eshelman |
| 3,333,373 | A | 8/1967 | Taylor et al. |
| 3,738,378 | A | 6/1973 | Williams |
| 3,810,482 | A | 5/1974 | Beavers |
| 3,929,146 | A | 12/1975 | Maiken |
| 4,077,417 | A | 3/1978 | Beavers |
| 4,148,332 | A | 4/1979 | Huddle |
| 4,201,237 | A | 5/1980 | Watts et al. |
| 4,280,521 | A | 7/1981 | Zeigler |
| 4,285,354 | A | 8/1981 | Beavers |
| 4,627,210 | A | 12/1986 | Beaulieu |
| 4,637,748 | A | 1/1987 | Beavers |
| 4,750,509 | A | 6/1988 | Kim |
| 4,787,182 | A | 11/1988 | Serge |
| 4,819,680 | A | 4/1989 | Beavers |
| 4,838,003 | A | 6/1989 | Zeigler |
| 4,941,499 | A | 7/1990 | Pelsue et al. |
| 4,971,090 | A | 11/1990 | Uhl |
| 5,195,551 | A | 3/1993 | Ju |
| 5,293,890 | A | 3/1994 | Park et al. |
| 5,328,286 | A | 7/1994 | Lee |
| 5,333,634 | A | 8/1994 | Taylor |
| 5,361,794 | A | 11/1994 | Brady |
| 5,423,341 | A | 6/1995 | Brady |
| 5,617,681 | A | 4/1997 | Lyons |
| 5,628,338 | A | 5/1997 | Stumbo |
| 5,634,483 | A | 6/1997 | Gwin |
| 5,666,986 | A | 9/1997 | Fox |
| 5,732,726 | A | 3/1998 | Lee |
| 5,797,695 | A | 8/1998 | Prusmack |
| 5,884,646 | A | 3/1999 | Ju |
| 5,943,837 | A | 8/1999 | Esser et al. |
| 6,021,795 | A | 2/2000 | Long et al. |
| 6,032,430 | A | 3/2000 | Soukup |
| 6,167,898 | B1 | 1/2001 | Larga et al. |
| 6,286,530 | B1 | 9/2001 | Hussey |
| 6,296,415 | B1 | 10/2001 | Johnson et al. |
| 6,516,823 | B1 | 2/2003 | Glover et al. |
| 6,591,571 | B2 | 7/2003 | Fritsche et al. |
| 6,604,844 | B2 | 8/2003 | Hussey |
| 6,666,223 | B2 | 12/2003 | Price et al. |
| 6,772,780 | B2 | 8/2004 | Price |
| 6,776,179 | B1 | 8/2004 | Chen |
| 6,854,476 | B1 | 2/2005 | Chai |
| 6,868,858 | B2 | 3/2005 | Suh |
| 6,874,519 | B2 | 4/2005 | Chiang |
| 6,892,744 | B2 | 5/2005 | Feldpausch et al. |
| 7,025,075 | B2 | 4/2006 | Suh |
| 7,040,585 | B2 | 5/2006 | Cheng et al. |
| 7,059,094 | B2 | 6/2006 | Yamawaki |
| D544,941 | S | 6/2007 | Rogers |
| 7,311,113 | B2 | 12/2007 | Suh |
| RE40,544 | E | 10/2008 | Suh |
| 7,481,235 | B2 | 1/2009 | Prusmack |
| 7,546,845 | B2 | 6/2009 | Prusmack |
| 2003/0005953 | A1 | 1/2003 | Erbetta et al. |
| 2007/0051399 | A1 | 3/2007 | Jung |
| 2007/0215192 | A1 | 9/2007 | Hoffman |

FOREIGN PATENT DOCUMENTS

| | | | |
|---|---|---|---|
| CN | 2506736 | Y | 8/2002 |
| CN | 2635827 | Y | 8/2004 |
| CN | 201129060 | Y | 10/2008 |
| GB | 2259927 | A | 3/1993 |
| GB | 2201703 | A | 9/1998 |

FOLDABLE TENT

CROSS REFERENCES TO RELATED APPLICATIONS

This application is a continuation of U.S. application Ser. No. 13/870,714, filed Apr. 25, 2013, which is a continuation of U.S. application Ser. No. 12/658,473, filed on Feb. 4, 2010, now U.S. Pat. No. 8,448,656, which is a continuation-in-part of PCT Application No. PCT/CN2008/073142, filed Nov. 21, 2008, which claims the benefit of priority to China Application No. 2007200089913, filed on Nov. 30, 2007, the contents all of which are incorporated herein by reference.

BACKGROUND OF THE INVENTION

1. Field of the Invention

The present invention relates to a foldable tent, and more particularly to a foldable tent which utilizes a hub or roof connecting mechanism.

2. Description of Prior Art

Hubs or roof connecting mechanisms of foldable tents are often used for pivotally connecting tent poles to a central location so that the tent would be able to have a foldable function.

Roof connecting mechanisms or hubs in the conventional bell tents are only provided for purposes of connecting components of the tent such as roof strut rods or poles. In other words, those parts require assembly and disassembly when the tent is pitched and stored away, respectively.

In larger conventional tents, the roof connecting mechanism or hub is kept in hinge connection with the roof strut rods or poles such that when the tent is folded, all of the roof strut rods or poles centrally pivot around the hub and are bent down so that the poles are gathered closely together. However, the larger conventional tents also require that the poles be further supported by sub-braces which connect from the poles to a downward extended portion of the hub. As a result, not only do the connecting mechanisms of the sub-braces become intricate but the overall structure of the tent framework becomes complicated. Moreover, the volume of the tent is larger due to the number of the components of the hub assembly, and opening and closing the tent becomes more difficult.

OBJECTS AND SUMMARY OF THE INVENTION

It is therefore a main object of the present invention generally is to provide a foldable canopy tent with a relatively smaller volume having a simplified roof connecting mechanism or hub for carrying out opening and closing functions without assembly or disassembly, which can also be manufactured at a low cost. For achieving the above-mentioned object, the present invention provides a roof connecting mechanism or hub of a foldable tent for pivotally connecting a plurality of radially spaced apart poles. The connecting hub comprises a base for preventing the poles from pivoting beyond the surface of the base.

In one aspect, the present invention provides a foldable tent convertible between an open configuration and a closed configuration, said tent comprising: a hub; a plurality of separate base members, each extending radially from the hub; a plurality of slots, each slot formed on a respective base member, the plurality of slots uniformly spaced apart radially, each slot formed by first and second walls, each of the first and second walls integrally formed on the respective base member and substantially parallel to each other, each of the first and second walls having a hole to form a pair of holes extending normally through the walls of each slot, the pair of holes being substantially aligned; a plurality of poles corresponding to the number of slots, each pole having at least two sections coupled by a joint, each pole having an inner end and an outer end, a hole extending through each pole proximate the inner end; a plurality of protective members, each protective member having a length and coupled to a respective pole inner end, a hole extending through each protective member substantially perpendicular to the length; a plurality of end members, each end member corresponding to and fixed to the outer end of each pole; and a plurality of pivot members corresponding to the number of slots, each pivot member of each slot defining a pivoting axis and extending through the hole of the first wall, the corresponding holes of each pole and protective member and the hole of the second wall, such that each pole is pivotally connected to a corresponding slot.

In another aspect, the present invention provides a foldable tent convertible between an open configuration and a closed configuration, said tent comprising: a hub; a base, portions of which form a plurality of separate base members, each base member extending radially from the hub; a plurality of slots, each slot formed on a respective base member, the plurality of slots uniformly spaced apart radially, each slot formed by first and second walls, each of the first and second walls integrally formed on the respective base member and substantially parallel to each other; a plurality of poles corresponding to the number of slots, each pole having at least two sections coupled by a joint, each pole having an inner end and an outer end; a plurality of protective members, each protective member having a length and coupled to a respective pole inner end; a plurality of end members, each end member corresponding to and fixed to the outer end of each pole; and a plurality of pivot members corresponding to the number of slots, each pivot member of each slot defining a pivoting axis and extending through the first and second walls, corresponding pole and corresponding protective member such that each pole is pivotally connected to a corresponding slot over a corresponding base member.

In another aspect, the present invention provides a foldable tent convertible between an open configuration and a closed configuration, said tent comprising: a hub; a substantially circular base having a plurality of separate base members, each extending radially from the hub; a plurality of slots, each slot formed on a respective base member, the plurality of slots uniformly spaced apart radially, each slot formed by first and second walls, each of the first and second walls integrally formed on the respective base member and substantially parallel to each other; a plurality of poles corresponding to the number of slots, each pole having at least two sections coupled by a joint, each pole having an inner end and an outer end, each pole inner end pivotally coupled to a corresponding slot, the hub and poles defining a periphery when the tent is in the open configuration; and a canopy positioned within the periphery, the canopy being slidably connected to the poles in the open and closed configurations.

BRIEF DESCRIPTION OF THE DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE PREFERRED EMBODIMENTS

Figure 1:
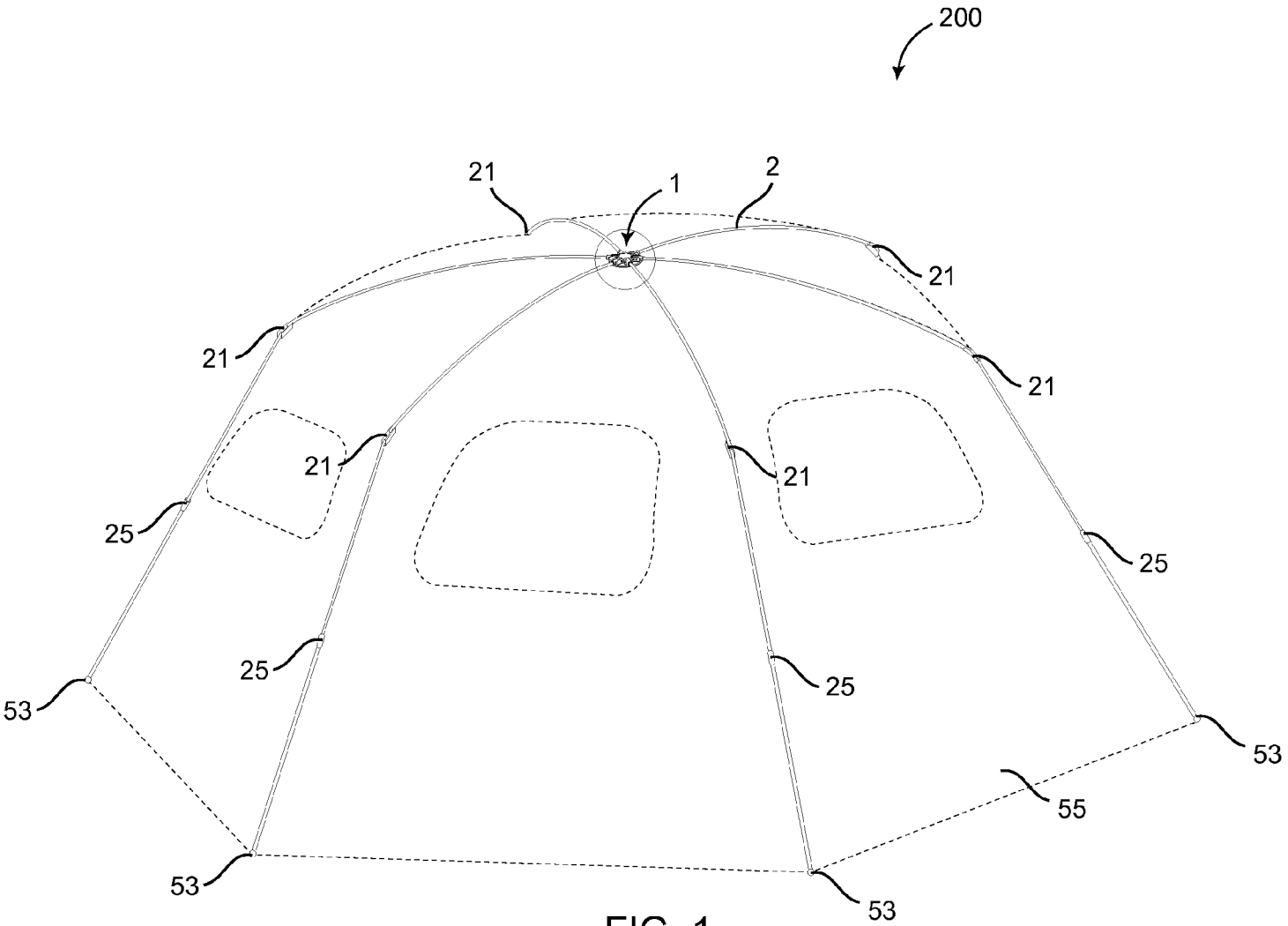
FIG. 1 is a perspective view of the foldable tent of the present invention in an open configuration.
Figure 2:
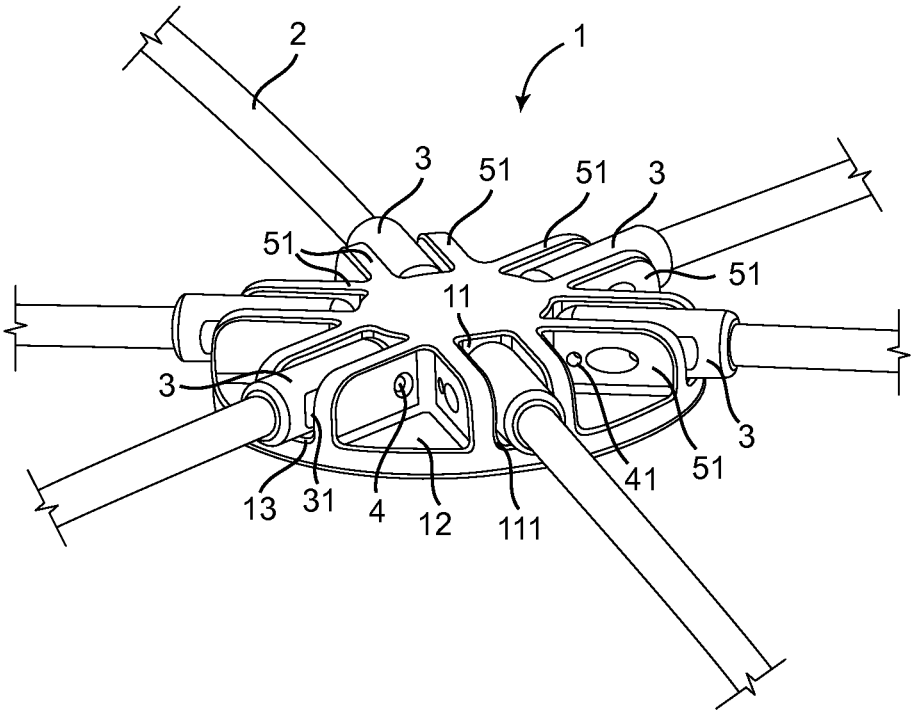
FIG. 2 is a perspective view of a first embodiment of a hub assembly of the present invention in an open configuration.
Figure 3:
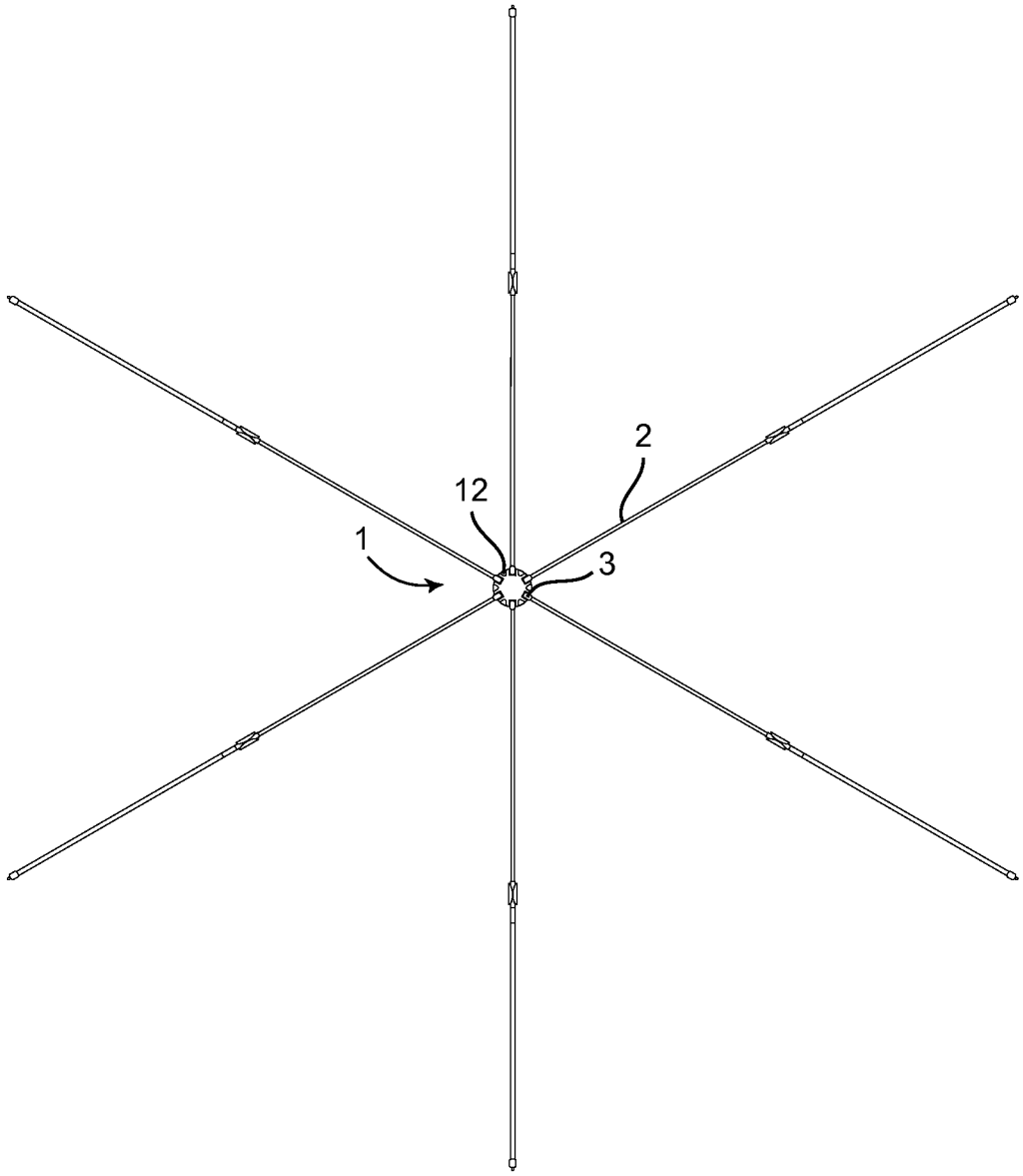
FIG. 3 is a plan view of the foldable tent of the present invention in a partially folded configuration.
Figure 4:
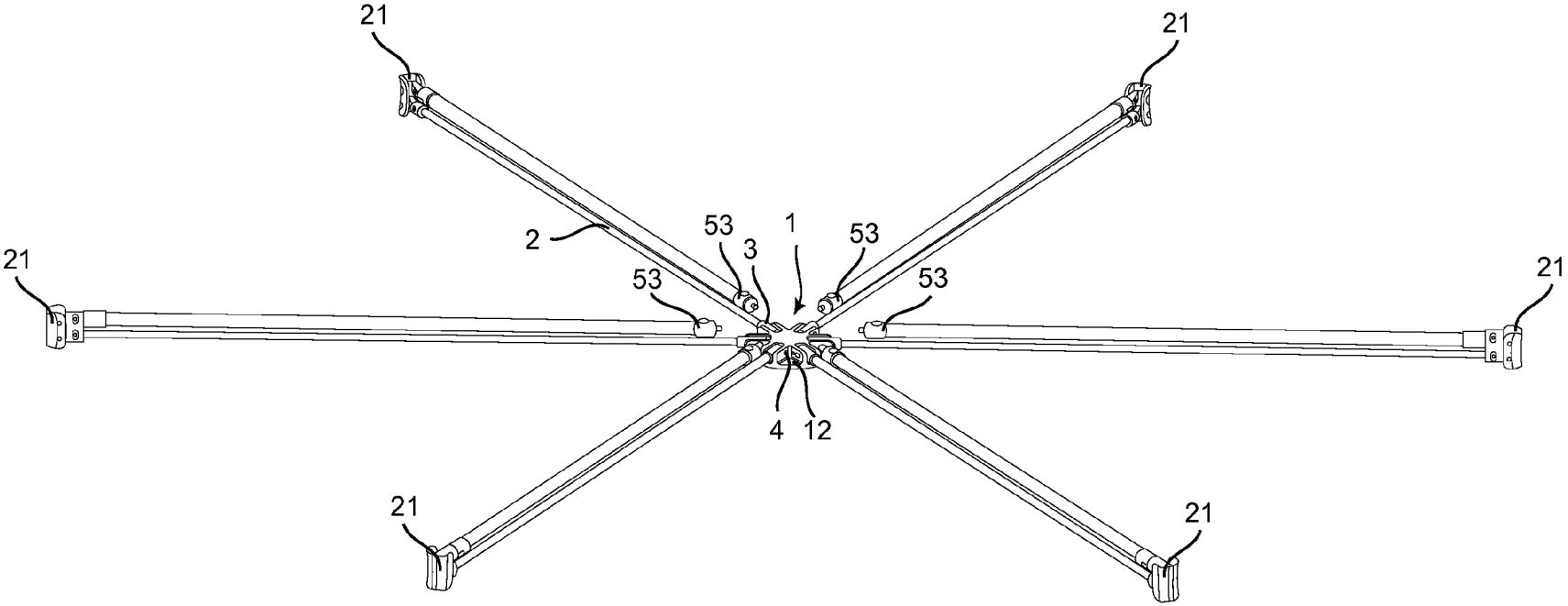
FIG. 4 is a perspective view of FIG. 3.

Referring to FIG. 1 to FIG. 4, a roof connecting mechanism or hub of foldable tent 200 having a canopy 55 in the first embodiment of the present invention is shown, in which the hub 1 is a circular piece having a plurality of pivoting cabinets, retaining assemblies or slots 11 extending upward from a stopper or base 12. Each slot 11 is formed on a base member 13 by a pair of independently extending adjacent walls 51 that include a curved groove 111 built upon the inner portions of the walls 51 forming each slot 11. The slots 11 are uniformly arranged in a radial configuration. The walls of each slot have pivoting holes 41 such that the holes are substantially aligned.

The hub assembly further comprises a plurality of roof strut rods or poles 2, each having at least two sections coupled by a joint 21, and each pole 2 is received by a corresponding slot 11. Each of the poles 2 are telescoping via a telescope locking member 25 and allows for the poles 2 to compact further in the closed configuration as described in more detail below. A pivoting cap or protective member 3 having a curved lug or curved outer surface 31 is fixed on the inner end of each pole 2 such that each cap 3 is sufficiently secured or tightly fit onto each pole 2. It is preferred that the external diameter of the pivoting cap 3 is less than or equal to the width of the inside of the slot 11, which allows for the each pole 2 to pivotally maneuver in and out of each corresponding slot 11. Each corresponding pole and cap have holes extending through the pole and cap such that the holes are substantially aligned.

Figure 8:
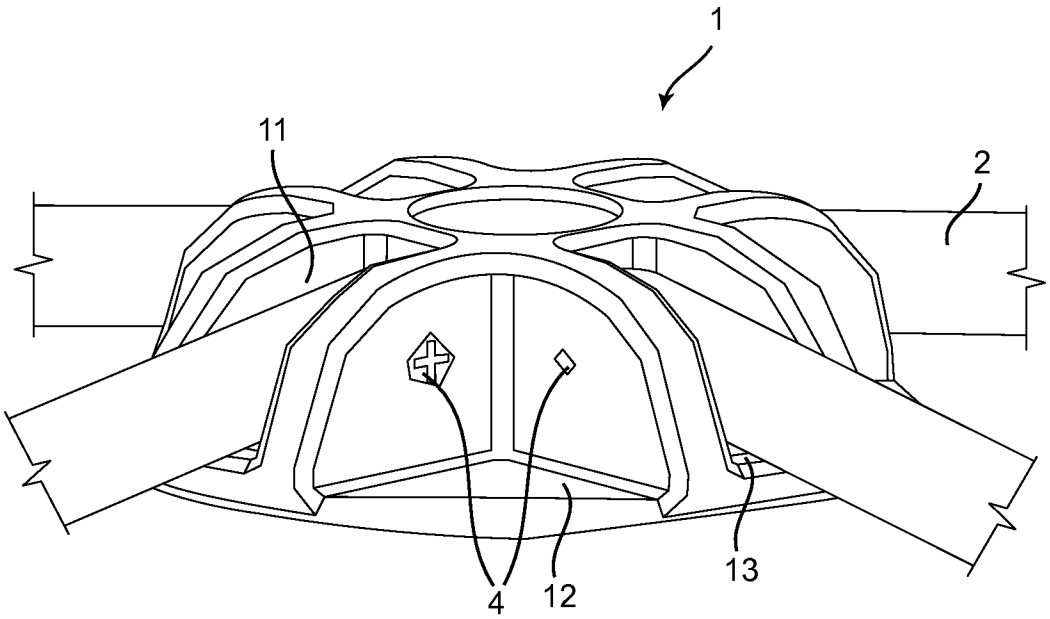
FIG. 8 is a partial perspective view of an alternative embodiment of a hub assembly of the present invention.

The poles 2 extend radially outward from the hub 1 and each pole 2 is pivotally connected to a corresponding slot 11 proximate the radially inner end of each slot 11. A pivoting pin or pivot member 4 extends through each cap 3 and corresponding pole 2 at a radially inner end of each cap 3 and each end of the pivoting pin 4 extends into the pivoting holes 41 on each side of the walls 51 of each slot 11 thereby forming a pivoting axis for the poles 2. The pivoting pin 4 can be any type of fastener such as a rod, bolt or screw as shown, for example, in FIGS. 2 and 8. Alternatively, the poles 2 can be directly connected to the connecting hub 1 without a pivoting cap as shown in FIG. 8.

In the first embodiment of the present invention, shown in FIGS. 1-4, the base 12 of each slot 11 extends to at least the portion of the poles 2 where the pivoting pins 4 are located and thus the inner ends of each pole 2 can pivot to and from the open and closed configurations within each corresponding slot 11.

In operation, the tent of the first embodiment is opened by pulling the frame of the tent, i.e., the poles 2, radially outward (see FIGS. 2-4) from the hub 1 such that the hub 1 is supported by the poles 2 and the poles 2 are telescopically extended, as shown in FIG. 1. The poles 2 include feet or end members 53 which are fixed to a supporting surface and the canopy 55 of the tent is expanded. The hub 1 and poles 2 form a periphery and frame of the tent 200. The canopy 55 is slidably engaged to the poles 2 and is positioned within the periphery. That is, an outer surface of the canopy 55 is coupled to the frame. During this time, each pole 2 is secured within each corresponding slot 11 through the engagement of the curved outer surface 31 of the caps 3 and the curved grooves 111 of the slot walls 51. Each pole 2 is further secured to each corresponding slot 11 by engaging the base 12 of the hub 1 and the tent 200 remains opened and securely erected.

Similarly, to close the tent the feet 53 of the poles 2 are first disengaged from the supporting surface. Without support from the feet of the poles 2, the hub 1 moves downward due to its weight and assists in the closing of the tent. The bottom portions of the poles 2 are telescopically retracted and folded radially inward toward the hub 1 (see FIGS. 3 and 4) and further pivoted radially inward until the poles 2 and canopy are gathered above the hub 1 in a compact closed configuration for convenient storage and transportability. The canopy is not shown in the FIGS. 2-4 in order to show the folding function in more detail.

Figure 5:
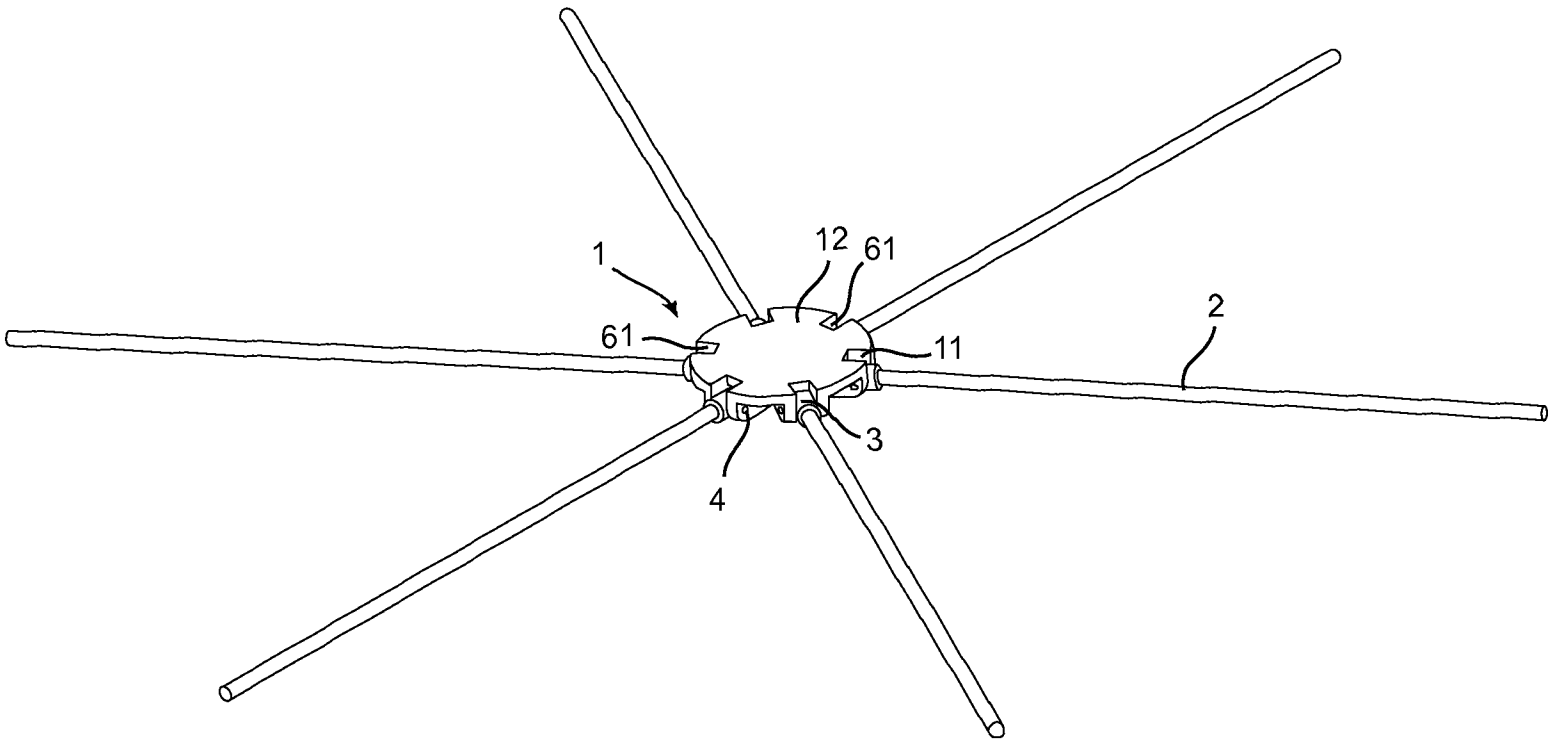
FIG. 5 is a partial top perspective view of a second embodiment of a hub assembly of the present invention in an open configuration.
Figure 6:
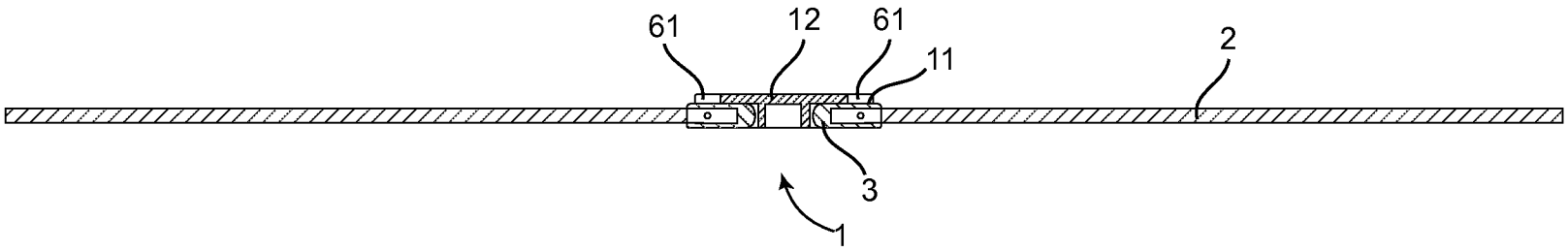
FIG. 6 is a partial sectional view of FIG. 5.
Figure 7:
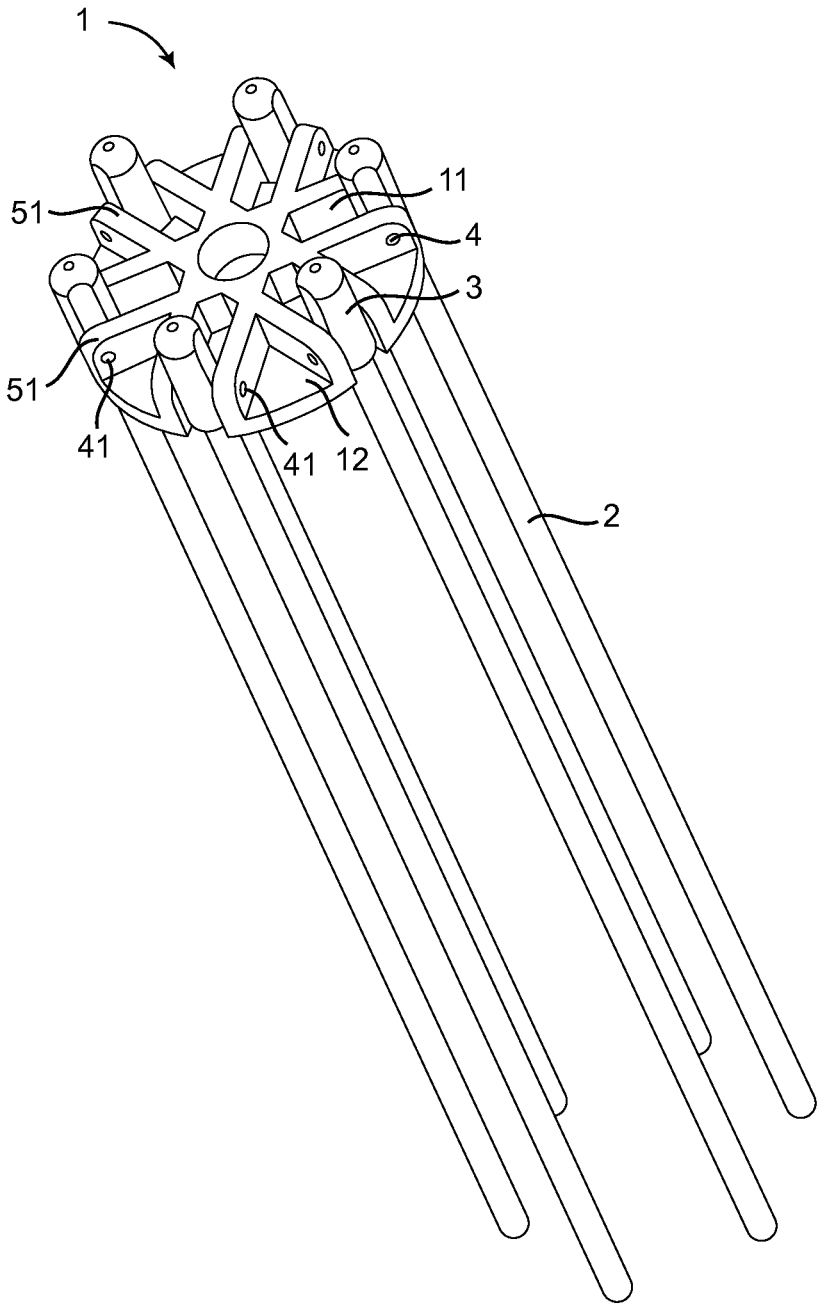
FIG. 7 is a partial bottom perspective view of the hub assembly of the second embodiment of the present invention in a folded configuration.

Referring to FIG. 5 to FIG. 7, a roof connecting mechanism or hub 1 of the foldable canopy tent 200 in the second embodiment of the present invention is shown, in which a connecting hub 1 is a circular piece having a plurality of pivoting cabinets or slots 11 extending downward from a stopper or base 12. The canopy of the tent is not shown in FIGS. 5-7 so that the hub 1 can be shown in more detail. Each slot 11 is formed by a pair of adjacent walls 51 which extend independently from the base 12, and each slot 11 is uniformly arranged in a radial configuration. The walls 51 of each slot 11 have pivoting holes 41 such that the holes are substantially aligned.

The hub assembly further comprises a plurality of roof strut rods or poles 2 and, similar to the arrangement in the first embodiment, each pole 2 is received by a corresponding slot 11. A pivoting cap or protective member 3 is fixed on the inner end of each pole 2 such that each cap 3 is sufficiently secured or tightly fit onto each pole 2. It is preferred that the external diameter of the pivoting cap 3 is less than or equal to the width of the inside of the slot 11, which allows for the cap 3 of each pole 2 to pivotally maneuver in and out of each corresponding slot 11. Each corresponding pole and cap have holes extending through the pole and cap such that the holes are substantially aligned.

The poles 2 extend radially outward from the hub 1 and each pole 2 is pivotally connected to a corresponding slot 11 proximate the radially outer end of each slot 11. A pivoting pin or pivot member 4 extends through each cap 3 and corresponding pole 2 at a radially outer end of each cap 3 and each end of the pivoting pin 4 extends into the pivoting holes 41 on each side of the walls 51 of each slot 11, thereby forming a pivoting axis for the poles 2. Alternatively, the poles 2 can be directly connected to the connecting hub 1 without a pivoting cap as shown in FIG. 8.

Referring again to FIGS. 5-7, the base 12 extends radially outward except that the base does not extend above the radially outer portions of the slots 11 where the poles 2 are pivotally connected to the walls 51, thereby forming an opening or a void 61. Thus, the radially inner portion of the base 12 restricts the inner end of the poles 2 from any upward pivotal movement beyond the bottom surface of the base 12 and as a result prevents the poles 2 from any downward pivotal movement beyond a position substantially parallel to the base 12 in the open configuration of the tent (see FIGS. 5 and 6). Moreover, the opening or void 61 provided on the radially outer portions of the slots 11 allow the poles 2 to pivotally move upward to the closed configuration of the tent (see FIG. 7).

In operation, similar to the operation of the tent in the first embodiment, the tent of the second embodiment is opened by pulling the frame of the tent, i.e., the poles 2, radially outward (see FIGS. 5 and 6) from the hub 1 and in a downward direction such that the hub 1 is supported by the poles 2. The feet or end members of the poles 2 are then fixed to the ground or other surface and the tent canopy is spread out, as illustrated in FIG. 1. During this time, the inner end of each pole 2 is secured within each corresponding slot 11 and the caps 3 of each pole 2 engages the bottom surface of the base 12 of the hub 1. Thus, the tent remains opened and securely erected.

Referring to FIG. 7, to close the tent, the feet of the poles 2 are first disengaged from the surface. Without support from the feet of the poles 2, the hub 1 moves downward due to its weight and assists in the closing of the tent. The poles 2 are folded radially inward toward the hub 1 as the radially inner ends of the poles 2 are pivoted to a position below the base 12. Thus, the poles 2 are gathered above the hub 1 in a compact closed configuration for convenient storage and transportability.

As described above, the slots 11 of the hub 1 not only restrict the poles 2 from pivoting beyond the base 12 in the open configuration but also provide for the poles 2 to pivot into a folded, compact closed configuration. Furthermore, the structure is simplified and the material cost is reduced while providing an easy and convenient opening and closing operation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A foldable tent convertible between an open configuration and a closed configuration, said tent comprising:

a canopy having inner and outer surfaces;

a hub;

a plurality of separate base members, each extending radially from the hub;

a plurality of slots, each slot formed on a respective base member, the plurality of slots uniformly spaced apart radially, each slot formed by first and second walls, each of the first and second walls integrally formed on the respective base member and substantially parallel to each other, each of the first and second walls having a hole to form a pair of holes extending normally through the walls of each slot, the pair of holes being substantially aligned;

a plurality of poles corresponding to the number of slots, each pole having at least two sections coupled by a joint, each pole having an inner end and an outer end, a hole extending through each pole proximate the inner end, wherein the hole proximate the inner end is substantially aligned with the holes in the first and second walls of the corresponding slot;

a plurality of protective members, each protective member having a length and coupled to a respective pole inner end of a corresponding pole, wherein each respective inner end of each pole are disposed between the first and second walls of a corresponding slot to be pivotally coupled to a corresponding slot, a hole extending through each protective member substantially perpendicular to the length and substantially aligned with the hole extending through the inner end of the corresponding pole;

a plurality of end members, each end member corresponding to and fixed to the outer end of each pole; and a plurality of pivot members corresponding to the number of slots, each pivot member of each slot defining a pivoting axis and extending through the aligned holes including the hole of the first wall, the corresponding holes of each pole and protective member and the hole of the second wall, such that each pole is pivotally connected to a corresponding slot;

wherein a substantial surface portion of the inner end of each pole engages a top surface of a corresponding base member when the tent is in the open configuration; and wherein the hub and poles define a frame of the tent, the canopy outer surface coupled to the frame.

2. The foldable tent of claim 1, wherein the protective member is substantially tubular, the protective member being fixed to an outer portion of the pole inner end.

3. The foldable tent of claim 2, wherein an inner surface of each of the walls have a groove and an outer surface of each of the protective members have a curved outer surface such that the protective member outer surface engages the wall inner surface when the tent is in the open configuration.

4. The foldable tent of claim 1, wherein the inner ends of the poles remain within the slot between the open and closed configurations.

5. The foldable tent of claim 1, wherein each base member is positioned on a top portion of the hub.

6. The foldable tent of claim 1, wherein each of the poles is pivotable upward with respect to a corresponding base member when the foldable tent is folded from the open configuration to the closed configuration.

7. A foldable tent convertible between an open configuration and a closed configuration, said tent comprising:

a canopy having inner and outer surfaces;

a hub;

a base, portions of which form a plurality of separate base members, each base member extending radially from the hub;

a plurality of slots, each slot formed on a respective base member, the plurality of slots uniformly spaced apart radially, each slot formed by first and second walls, each of the first and second walls integrally formed on the respective base member and substantially parallel to each other, each of the first and second walls having a hole to form a pair of holes extending normally through the walls of each slot, the pair of holes being substantially aligned;

a plurality of poles corresponding to the number of slots, each pole having at least two sections coupled by a joint, each pole having an inner end and an outer end, a hole extending through each pole proximate the inner end, wherein the hole proximate the inner end is substantially aligned with the holes of the first and second walls of the corresponding slot;

a plurality of protective members, each protective member having a length and coupled to a respective pole inner end of a corresponding pole, wherein each respective inner end of each pole are disposed between the first and second walls of a corresponding slot to be pivotally coupled to a corresponding slot, a hole extending through each protective member substantially perpendicular to the length and substantially aligned with the hole extending through the inner end of the corresponding pole;

a plurality of end members, each end member corresponding to and fixed to the outer end of each pole; and a plurality of pivot members corresponding to the number of slots, each pivot member of each slot defining a pivoting axis and extending through the aligned holes including the hole of the first and second walls, corresponding pole and corresponding protective member such that each pole is pivotally connected to a corresponding slot over a corresponding base member;

wherein a substantial surface portion of the inner end of each pole engages a top surface of a corresponding base member when the tent is in the open configuration; and wherein the hub and poles define a frame of the tent, the canopy outer surface coupled to the frame.

8. The foldable tent of claim 7, wherein the protective member is substantially tubular, the protective member being fixed to an outer portion of the pole inner end.

9. The foldable tent of claim 8, wherein an inner surface of each of the walls have a groove and an outer surface of each of the protective members have a curved outer surface such that the protective member outer surface engages the wall inner surface when the tent is in the open configuration.

10. The foldable tent of claim 7, wherein the inner ends of the poles remain within the slot between the open and closed configurations.

11. The foldable tent of claim 7, wherein each of the poles is pivotable upward with respect to the base when the foldable tent is folded from the open configuration to the closed configuration.

12. A foldable tent convertible between an open configuration and a closed configuration, said tent comprising:

a canopy having inner and outer surfaces;

a hub;

a base having a plurality of separate base members, each extending radially from the hub;

a plurality of retaining assemblies, each retaining assembly extending radially from the hub and having first and second walls forming a slot, each of the first and second walls having a hole to form a pair of holes extending normally through the walls of each slot, the pair of holes being substantially aligned; and a plurality of poles corresponding to the number of retaining assemblies, each pole having at least two sections coupled by a joint, each pole having an inner end and an outer end, a hole extending through each pole proximate the inner end, wherein the hole proximate the inner end is substantially aligned with the holes in the first and second walls of the corresponding slot, each pole inner end disposed between the first and second walls of the slot of a corresponding retaining assembly to be pivotally coupled to a corresponding retaining assembly;

a plurality of protective members, each protective member having a length and coupled to a respective pole inner end of a corresponding pole, wherein each respective inner end of each pole are disposed between the first and second walls of a corresponding slot to be pivotally coupled to a corresponding slot, a hole extending through each protective member substantially perpendicular to the length and substantially aligned with the hole extending through the inner end of the corresponding pole;

a plurality of pivot members corresponding to the number of slots, each pivot member of each slot defining a pivoting axis and extending through the aligned holes include the hole of the first wall, the corresponding holes of each pole and protective member, and the hole of the second wall, such that each pole is pivotally connected to a corresponding slot;

wherein a substantial surface portion of the inner end of each pole engages a top surface of a corresponding base member when the tent is in the open configuration; and wherein the hub and poles define a frame of the tent, the canopy outer surface coupled to the frame.

13. The foldable tent of claim 12, wherein each retaining assembly is positioned on a corresponding base member and extends substantially normal therefrom.

14. The foldable tent of claim 12, wherein each of the poles is pivotable upward with respect to the base when the foldable tent is folded from the open configuration to the closed configuration.

* * * * *